US008002038B2

(12) United States Patent
Wilson

(10) Patent No.: US 8,002,038 B2
(45) Date of Patent: Aug. 23, 2011

(54) LIQUID CARBON DIOXIDE CLEANING OF WELLBORES AND NEAR-WELLBORE AREAS USING HIGH PRECISION STIMULATION

(75) Inventor: Dennis Ray Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 401 days.

(21) Appl. No.: 11/930,919

(22) Filed: Oct. 31, 2007

(65) Prior Publication Data

US 2008/0142226 A1 Jun. 19, 2008

Related U.S. Application Data

(63) Continuation-in-part of application No. 11/612,325, filed on Dec. 18, 2006, now Pat. No. 7,677,317.

(51) Int. Cl.
*E21B 21/14* (2006.01)
*E21B 37/06* (2006.01)

(52) U.S. Cl. ..... 166/312; 166/279; 166/304; 166/306; 166/402

(58) Field of Classification Search ..... None
See application file for complete search history.

(56) References Cited

U.S. PATENT DOCUMENTS 3,368,627 A 2/1968 Hurst et al.

(Continued)

FOREIGN PATENT DOCUMENTS

EP 03 25 0274 1/2003

OTHER PUBLICATIONS

Halliburton Communications, CobraMax Fracturing Service Provides the Performance of Conventional Through Tubing Fracturing with the Speed and Versatility of Coiled Tubing . . . .

(Continued)

*Primary Examiner* — Zakiya W. Bates

(57) ABSTRACT

The invention relates to cleaning wellbores and the near wellbore areas adjacent to a hydrocarbon bearing formations and coal bed methane formations. In a particular aspect, the invention relates to removing liquids such as water and/or oil from the formation near the wellbore. The cleaning and liquid removal is accomplished with liquid carbon dioxide or a treatment medium that includes liquid carbon dioxide. The treatment medium is injected into the wellbore through tubing in a controlled manner so that the treatment medium enters the formation in a liquid state, although a portion may be allowed to vaporize upon introduction into the wellbore. The treatment medium is then allowed to vaporize and loosen and entrain undesirable materials from the formation and from within the wellbore or casing, and mobilize water and oil present by effervescing and by dissolving. The water and oil may be blown or pumped to the surface or, if the present invention is practiced in a coal bed methane formation, may be driven into the coal bed methane formation such that it may no longer impose a barrier to methane production. In certain embodiments, the gaseous portion of the treatment medium is allowed to escape through the wellhead, carrying out the undesirable materials.

23 Claims, 3 Drawing Sheets

U.S. PATENT DOCUMENTS

| | | | | |
|---|---|---|---|---|
| 3,700,034 | A | 10/1972 | Hutchison | |
| 3,871,451 | A | 3/1975 | Brown | |
| 5,099,924 | A | 3/1992 | Gidley | |
| 5,147,111 | A | 9/1992 | Montgomery | |
| 5,232,050 | A | 8/1993 | Gidley | |
| 5,265,678 | A | 11/1993 | Grundmann | |
| 5,310,002 | A * | 5/1994 | Blauch et al. | 166/307 |
| 5,358,052 | A | 10/1994 | Gidley | |
| 5,411,098 | A * | 5/1995 | Schmidt et al. | 166/369 |
| 5,883,053 | A | 3/1999 | Tudor | |
| 6,024,171 | A | 2/2000 | Montgomery et al. | |
| 6,286,599 | B1 | 9/2001 | Surjaatmadja et al. | |
| 6,602,916 | B2 | 8/2003 | Grundmann et al. | |
| 6,988,552 | B2 | 1/2006 | Wilson et al. | |
| 7,007,865 | B2 | 3/2006 | Dodd | |
| 7,007,868 | B1 | 3/2006 | Chen | |
| 2004/0157749 | A1 | 8/2004 | Ely et al. | |
| 2008/0035345 | A1 * | 2/2008 | Kosakewich | 166/302 |

OTHER PUBLICATIONS

Halliburton Communications, "SurgiFrac Service—Fracture Stimulation Technique for Horizontal Completions in Low-to Medium-Permeability Reservoirs", 2005, 6 pgs.

Advanced Resources International under Contract 68-W-00/0094, "Fracturing Technologies for Improving CMM/CBM Production", 10 pages.

Halliburton Communications, "Cobra Frac Service—Cost-Effective Method for Stimulating Untapped Reserves—Proved in More Than 30,000 Fracture Treatments", 2005, 2 pages.

T.L. Logan, M.J. Mavor, Resource Enterprises, Inc.; and M. Khodaverdian, TerraTek, Inc., "Optimizing and Evaluation of Open-Hole Cavity Completion Techniques for Coal Gas Wells", Proceedings of the 1993 International Coalbed Methane Symposium, The University of Alabama/Tuscaloosa, May 17-21, 1993, pp. 609-622.

* cited by examiner

LIQUID CARBON DIOXIDE CLEANING OF WELLBORES AND NEAR-WELLBORE AREAS USING HIGH PRECISION STIMULATION

This is a continuation-in-part application of U.S. patent application Ser. No. 11/612,325 filed on Dec. 18, 2006 now U.S. Pat. No. 7,677,317.

TECHNICAL FIELD

The present invention relates to compositions and methods to clean wellbores and near-wellbore areas, and in particular, a method for using a treatment medium containing liquid carbon dioxide which may be introduced or jetted through a conduit such as rigid or flexible "coiled" tubing at high pressure to clean wellbore sections and the near-wellbore area of a hydrocarbon bearing formation. Another aspect of the present invention relates to the use of an apparatus and treatment medium comprising liquid carbon dioxide which may be used to clean the inner surface of the casing as well as perforations formed in the casing. In yet another aspect, the present invention relates to methods and apparatus used in connection with a treatment medium comprising liquid carbon dioxide to erode slots or other contours in the wellbore to increase surface area of the wellbore. In yet another aspect, the present invention relates to methods and apparatus for fracturing fluid or gas bearing formations using a treatment medium comprising liquid carbon dioxide. More specifically, the method, apparatus and treatment medium may find application in the treatment of wells and near-wellbore areas located in methane-producing coal beds. In these types of wells, referred to herein as coal bed methane wells, the introduction of water into the micro-cleat system of the coal formation may interfere with the production of methane. In particular, water may act to block the natural flow paths through which the methane is produced. While in high pressure wells, the formation pressure may be sufficient to overcome the presence of the water thereby continuing the flow of methane, when formation pressure drops, the water may cause a decrease in methane production, or may halt production altogether. The methods, apparatus and treatment medium of the present invention, particularly the use of liquid carbon dioxide, may be used to mobilize the undesirable water and/or oil present in the formation, restoring methane production. With that said, it should be understood that the invention described herein may be suited for use in connection with various types of wells whether the well is producing methane or some other gas, liquid petroleum, water or some other desirable fluid or gas.

BACKGROUND OF THE INVENTION

In the operation of a well, there may be any number of processes which may act to reduce production from the well. Initial drilling processes can create significant amounts of debris, including rock particulates, rock dust and oil mist. In addition, drilling muds and fluids may contain chemicals which can reduce the ability of the formation to produce fluids by reacting with the formation and/or formation fluids to produce precipitates and/or scale. Furthermore, some fluids may also cause clays within the formation to swell, further blocking the formation's ability to flow. The use of fluid loss control fluids may result in filter cake invading the near wellbore area, which could also decrease the formation near wellbore permeability. Over time, additional processes may act to allow water to imbibe into the formation, and/or asphaltenes and paraffins may deposit in the near wellbore area. For example, a well may be shut down for maintenance operations, such as the replacement of tubing. During this shut down, water may creep into the well and/or near-wellbore formation. Additionally, as formation pressure naturally decreases over time, the formation may no longer have sufficient pressure to drive water from the micro cleat system of the formation. Any one of these processes may act to decrease near wellbore permeability and production.

While wells may generally be drilled vertically, in some applications, it may be desirable to steer the wellbore away from vertical, or a wellbore may unintentionally deviate from vertical. It is possible to drill a well in which one or more portions of the wellbore travel horizontally or even such that they are angled up towards the surface. These wells with at least partially non-vertical wellbores are known as deviated or horizontal wells, and are frequently employed with formations which have low natural pressure as this technique increases wellbore exposure to the hydrocarbon-bearing formation. It is also possible to create multiple wellbore segments extending off a main horizontal wellbore. These multiple segments may comprise lateral segments or may form a fishbone-like structure. Furthermore, a vacuum may be employed where the formation pressure is insufficient for economic production. Regardless of the physical characteristics of the well, when the formation pressure or natural driving force is low, wells are particularly susceptible to the problems associated with deposits, rock dust/drilling fluids becoming impacted on the rock face, and/or imbibed water.

Furthermore, degradation may occur regardless of the manner in which the well is completed. Depending on the formation being drilled into and other factors known in the art, it may be desirable to insert a casing into the wellbore. In situations where casing is inserted into the entire wellbore, the well is known as a cased well. In contrast, if no casing is used, the well is known as an open hole well; and, if only a portion of the wellbore is cased, the well may be known as a partially cased hole or partially open hole. When pipe is run into an open hole section and not cemented in place it is called a liner and the well an open hole completion with liner. In some instances the liner may later be pulled or removed for various reasons. Again, regardless of whether a casing or liner is used, one or more of the previously described processes may act to reduce production.

For some wells, it may be desirable to increase formation flow by fracturing the fluid or gas bearing formation. One fracturing method involves the introduction of a fracturing fluid into the formation at high pressure such that cracks in the rock or fractures within the formation are caused to form. These fractures may be effective in increasing the permeability of the formation, and may bypass wellbore damage such as skin damage in the near wellbore area. In some instances a proppant such as natural sand, or engineered products such as coated sand or sintered bauxite may be used. The proppant may be mixed with the fracturing fluid so that following injection of the fracturing fluid, the proppant may be left in the created fractures, holding them open so that permeability is not lost. However, the use of fracturing fluid itself may adversely affect production as the fluid may act to block pores in the formation.

In yet other wells, it may be desirable to increase the surface area of the wellbore, as this may provide additional paths for fluid or gas to migrate from the formation to the wellbore. This additional surface area may be created by forming slots or other contours in the surface of the wellbore. However, again, care must be taken to ensure that in the process of creating the slots, additional debris is not introduced such that it could act to block the formation and hinder production.

In coal bed methane wells, methane is produced from coal formations. During coal mining operations, the presence of the methane is a hazard and it is desirable to degasify, or to remove as much of the methane from the coal formation as possible prior to coal mining operations. It is known to remove the methane from the coal formations through the use of wells. Of course, a methane well may be drilled into a coal bed formation not necessarily for the purpose of degasification, but for the purpose of extracting the methane.

However, as with other types of gas wells, production from a well drilled in a coal bed methane formation may be reduced due to water flooding or due to a buildup of paraffin or undesirable oil within the near-wellbore formation. The source of the water may be either natural, such as natural loading, or may be the result of well operations such as fracturing techniques, casing leaks or, as noted above, water may creep into the well and/or near-wellbore formation during well shut downs. Regardless of its source, the introduction of water into the coal formation may reduce the formation's gas permeability either by blocking gas flow paths, or through the swelling of formation clays.

Thus, there still remains a need for methods and compositions for cleaning wellbore and near-wellbore areas from damage related to drilling, work over operations and natural degradation of the wellbore from production, especially in low pressure formations. There is an additional need to perform cleaning in a manner such that an operator may precisely control the location of the cleaning. There is also a need for methods and apparatus suitable for cleaning a wellbore casing. There is an additional need for methods, apparatus and compositions suitable for increasing gas production in a coal bed methane formation by, for example, restoring the relative gas permeability of the coal bed methane formation. There is also a need for methods, apparatus and compositions suitable for removing water from a coal bed methane formation. Furthermore, there is a need for methods, apparatus and compositions used in the slotting and fracturing of a formation which leave substantially clean slots and/or fractures in the wellbore and near wellbore areas.

BRIEF SUMMARY OF THE DRAWINGS

The present invention will be more fully understood from embodiments of the invention described in the detailed description together with the drawings provided to aid in understanding, but not limit the invention.

SUMMARY OF THE INVENTION

Figure 1:
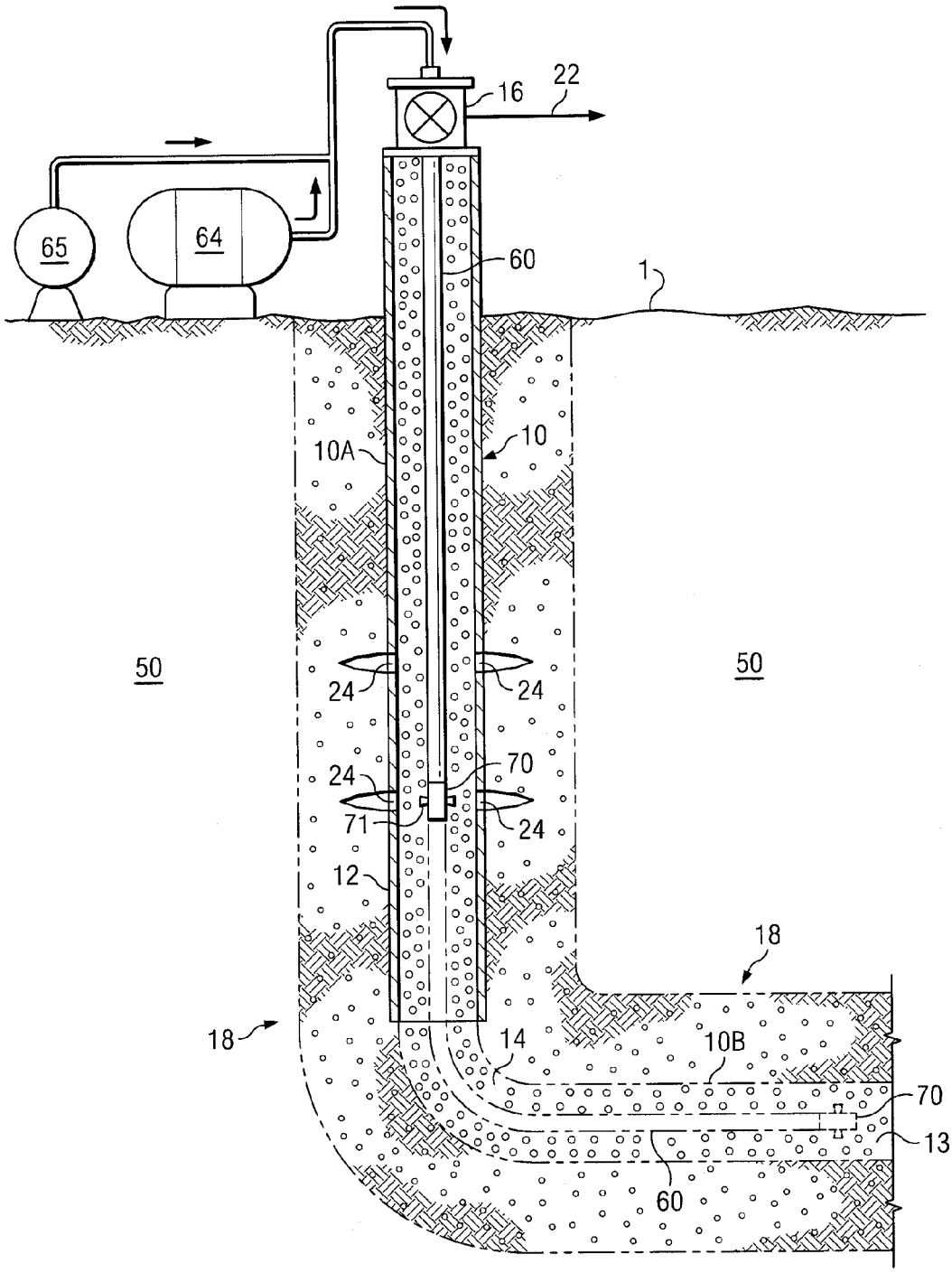
FIG. 1 is a schematic view of a partially cased well having a vertical section and deviated section and illustrating certain aspects of the present invention.

In one embodiment of the present invention there is provided a method for cleaning a wellbore in a formation comprising the steps of a) inserting a desired length of tubing into the wellbore; b) introducing a treatment medium comprising liquid carbon dioxide through the tubing into one or more locations within the wellbore and into at least a portion of the formation adjacent to the wellbore; and c) vaporizing at least a portion of said treatment medium after it is injected into said wellbore.

In an alternate embodiment of the method of the present invention, flexible or coiled tubing can be used. In another embodiment, the treatment medium may impinge the casing perforations, the casing and/or the wellbore through the use of a nozzle or jetting tool which may be either affixed to, or integral with, the tubing. In another embodiment, the treatment medium can be injected into the wellbore and/or near wellbore areas such that the pressure within the formation remains below the fracturing pressure of the formation. In another embodiment, once the treatment medium has been injected, the pressure within the well may be cycled between high pressure and low pressure states. In yet another embodiment, depressions or slots can be formed in the formation in the wellbore.

In another embodiment of the present invention, a method is disclosed for removing undesirable materials such as rock particulates, rock dust, oil mist, water, imbibed water, asphaltenes, paraffins, scale, precipitates, heavy brines, gels and the like which may deposit in perforations formed through the casing and/or on the inner surface of the casing itself. This method comprises the steps of: a) inserting into the casing a known length of tubing such that the tubing terminates at a known location within the casing; b) delivering, through the tubing, a treatment medium comprising at least a portion of liquid carbon dioxide to the known location; c) lowering the pressure within the wellbore to partially vaporize the treatment medium such that the partially vaporized treatment medium entrains and/or dissolves undesirable materials; and d) allowing the partially vaporized treatment medium and entrained undesirable materials to exit the casing.

In yet another embodiment of the present invention, a composition for the treatment of a wellbore and/or near wellbore area is disclosed wherein the composition is a treatment medium comprising liquid carbon dioxide, alcohol, surfactant, corrosion inhibitor, acid, iron-control chemical, biocide and/or abrasives, for example sand, ceramics, bauxite, garnet and the like.

In yet another embodiment of the present invention, a method is disclosed for fracturing a fluid bearing formation having a wellbore comprising the steps of a) introducing a quantity of fracturing fluid into the wellbore sufficient to fracture the formation; b) introducing a treatment medium comprising liquid carbon dioxide into the wellbore; and c) vaporizing at least a portion of the treatment medium.

In yet another embodiment of the present invention, the method of fracturing a fluid bearing formation further comprises the steps of: a) regulating pressure within the wellbore and the formation such that at least a portion of the treatment medium remains in a liquid state following injection into the wellbore; b) inserting a length of tubing into the wellbore such that an annulus is created between the tubing and the wellbore; c) pumping the treatment medium through the tubing; d) pumping the fracturing fluid into the annulus; e) injecting the treatment medium into the fracturing fluid to create a mixed fracturing fluid; f) impinging the mixed fracturing fluid against the formation; g) creating at least one fracture in the formation; h) driving the mixed fracturing fluid into the formation; and i) releasing the pressure within said wellbore.

In yet another embodiment of the present invention, an apparatus for use in introducing a treatment medium into a desired space is disclosed comprising: a) a storage means for storing a quantity of a treatment medium; b) a pumping means for delivering the treatment medium to a transport means; c)

wherein the transport means is inserted into a space and is operable to transport a quantity of the treatment medium to a location within the space; and d) means for directing the treatment medium onto a location within the space; and wherein the treatment medium is comprised of liquid carbon dioxide.

In yet another embodiment of the present invention, an apparatus for use in hydraulically fracturing a fluid bearing formation is disclosed comprising: a) a storage means for storing a quantity of a treatment medium comprised of liquid carbon dioxide; b) a storage means for storing a quantity of a fracturing fluid; c) first pumping means for delivering the treatment medium to a first transport means; d) second pumping means for delivering the fracturing fluid to a second transport means; e) wherein the first transport means is inserted into the second transport means and is operable to transport a quantity of the treatment medium to a location within the second transport means; and f) means for directing the treatment medium such that it mixes with the fracturing fluid, producing a second fracturing fluid such that the second fracturing fluid impinges the fluid bearing formation. In alternate embodiments of this apparatus, the means for directing the treatment medium may comprise a jetting tool. Furthermore, the first transport means may comprise flexible tubing, while the second transport means may be the annulus between the flexible tubing and the wellbore. Furthermore, storage, pumping and mixing means may be provided for proppant and any additives that an operator may wish to introduce to the wellbore.

In yet another embodiment of the present invention, a method is provided for removing water and/or oil from the near-wellbore formation in a coal bed methane formation comprising the steps of a) inserting a desired length of tubing into the wellbore; b) introducing a treatment medium comprising liquid carbon dioxide through the tubing into one or more locations within the wellbore and into at least a portion of the formation adjacent to the wellbore; and c) vaporizing at least a portion of said treatment medium after it is injected into said wellbore In yet another embodiment of the present invention, a method is provided for restoring the relative gas permeability of a coal bed methane formation comprising the steps of: a) regulating pressure within the coal bed methane formation as well as within a wellbore located within the coal bed methane formation such that at least a portion of a treatment medium remains in a liquid state following injection into the wellbore; b) inserting a length of tubing into the wellbore such that an annulus is created between the tubing and the wellbore; c) pumping the treatment medium through the tubing and into the annulus; and d) releasing the pressure within said wellbore.

DETAILED DESCRIPTION

FIG. 1 is provided to assist in the understanding of the invention. In a well, there is a wellbore 10 which extends from the surface 1 into a hydrocarbon bearing formation 50. The hydrocarbon bearing formation may bear gas and/or oil. In some applications, a casing 12 may be inserted in wellbore 10. As illustrated in FIG. 1, casing 12 extends the length of vertical wellbore section 10A. However, casing 12 does not extend into the deviated and/or horizontal section 10B of the wellbore 10 which is shown in phantom. As illustrated by FIG. 1, wellbore 10 can be drilled in any number of orientations from vertical to horizontal, angles in between, and angles beyond horizontal such that the wellbore is actually drilled back towards the surface. Of course, the present invention may be used with other well configurations such as wells with multiple laterals and those with fishbone configurations. For the purposes of this description, the term horizontal well will be used to refer to wells with deviated and horizontal wellbores, multilateral wells and fishbone configurations.

Horizontal wells are frequently used in circumstances where the natural pressure in the formation 50 is low. In instances where natural pressure is ineffective in driving fluids from the formation, horizontal wells may be a useful means for improving production as they increase the area of the hydrocarbon bearing formation exposed to the wellbore. In addition to using directional drilling, other alternatives such as applying a vacuum to the well can be employed to increase production. Nevertheless, whenever the pressure within the formation is low, wells are prone to suffer from deposits, imbibed fluids, and impacted particulates which can reduce production from the well. The compositions, apparatus and methods of the present invention overcome these problems by cleaning the wellbore, the casing and/or near-wellbore area, or by increasing the surface area of the wellbore, or by fracturing formation 50, in each case thereby improving production from the well.

To combat blockage which may occur as a result of the drilling process, such as that resulting from an accumulation of rock particulates, rock dust, oil mist, and/or drilling muds or fluids which may result from the drilling process, the method of the present invention involves introducing and/or injecting a treatment medium comprising at least a portion of liquid carbon dioxide into wellbore 10 via either coiled or rigid tubing 60, which has been inserted into wellbore 10. In this method, at least a portion of the treatment medium remains in a liquid and/or dense phase state as it impinges the downhole structure of wellbore 10 and flows into the near wellbore area 18. A jetting tool or nozzle 70 may be affixed to, or integral with, the end of tubing 60 to focus the treatment medium as it exits tubing 60. Jetting tool 70 may have one or more protrusions 71 or holes (not shown) through which the treatment medium may pass. Prior to introduction/injection, the treatment medium may be kept in the liquid state in a pressurized tank or tanks 64 (which may or may not be mobile) at the surface. In one embodiment, the well may be kept closed to ensure that the pressure therein remains sufficiently high such that the treatment medium may not immediately vaporize upon introduction and/or injection to the well. Once a desired amount of treatment medium has been introduced and/or injected, the well may be opened, thereby releasing pressure and causing at least a portion of the treatment medium to vaporize. As the vaporized portion of the treatment medium expands, it may seek to escape the high pressure environment of the wellbore by exiting through the wellhead at the surface.

As the treatment medium impinges the face of wellbore 10 and flows into the near-wellbore area 18, it is believed to create some fine cracks or localized fractures near the wellbore. By using a highly precise, directed application of treatment medium, an operator may be able to cause beneficial localized cracks which may allow the treatment medium to enter the face of the formation 50.

The method described above may be used in vertical or horizontal wellbores, however, in horizontal wellbores, one application of the present invention involves positioning jetting tool 70 at the toe 13 of the horizontal wellbore section 10B, injecting or introducing the treatment medium, and then drawing tubing 60 back while continuing to inject or introduce treatment medium such that jetting tool 70 may be ultimately positioned at heal 14 of horizontal wellbore section 10B. Of course the direction in which jetting tool 70 is moved may be reversed such that the process begins at heal 14 and ends at toe 13. In either case, treatment medium may be introduced along the length of some portion of horizontal wellbore section 10B. Of course, if treatment is not desired along the entire length of wellbore section 10B, jetting tool 70 need not be drawn completely to heal 14 or toe 13. Additionally, the jetting tool 70 may be used to introduce treatment medium along the length, or portions of the length, of the vertical wellbore section 10A of the wellbore 10.

As described above, the treatment medium can be either allowed to at least partially vaporize as it is introduced, or, once a desired quantity of treatment medium has been introduced into a closed well, the well may be reopened to allow vaporization. High pressure within tubing 60 may enable high pressure, high velocity jetting which will maintain at least a portion of the liquid carbon dioxide within the treatment medium in a liquid or supercritical state, injecting in into the rock face in that state. In either case, rapid depressurization allows at least a portion of the treatment medium comprising carbon dioxide to energetically vaporize and expand. It is this expansion that can provide the energy necessary to clean wellbore 10 and near wellbore area 18. This expansion can be effective in loosening the previously described undesirable materials resulting from the drilling process and/or skin damage from wellbore 10 and near wellbore area 18. Specifically, the expansion not only cleans, but as described, may cause erosion of the wellbore 10 which may bypass drilling damage. Furthermore, the high pressure injection of a treatment medium containing liquid carbon dioxide into the pore spaces of the near wellbore area 18 and depressurization can supply energy to mobilize water, oil, emulsions and particulates back into the wellbore and ultimately to the surface.

Liquid carbon dioxide is also known to act as a solvent for oil and is soluble in water. When allowed to vaporize, the treatment medium comprising liquid carbon dioxide dissolved in water and/or oil present in the formation can effervesce. This action is thought to be sufficient to defeat capillary forces present in the pore spaces of near wellbore area 18 and allow the liquid treatment medium mixture to become mobile. Thus, through one or more processes, the expansion of the treatment medium can be effective in sweeping water, dust, oil and other drilling process residue from wellbore 10 and near wellbore area 18. As at least a portion of the treatment medium vaporizes, that gaseous portion will naturally seek an escape from wellbore 10 to surface 1 through well head 16. As the gaseous portion of the treatment medium travels through wellbore 10, it will naturally sweep and carry or entrain dislodged particulates, oil, water and other drilling process residue from wellbore 10 to the surface.

Once the gaseous treatment medium, fluid and particulate mixture has arrived at wellhead 16, it may exit to a pit or lay down tank (not shown) wherein at least a portion of the treatment medium may be separated from the particulates and in turn recaptured or released.

In the present embodiment, the liquid carbon dioxide present in the treatment medium is believed to provide additional modes of cleaning and/or erosion. Specifically, as described previously, liquid carbon dioxide is known to be an effective solvent for petroleum products such as grease and oils. In the present embodiment, the liquid carbon dioxide is believed to be effective in dissolving some forms of drilling process residue such as the petroleum-based products introduced into wellbore 10 to lubricate and cool the tools used in the well drilling process. Left untreated, these petroleum products may act to coagulate the debris left from the drilling process. The coagulated mass may further contribute to slowing production. Thus, the introduction of a treatment medium containing liquid carbon dioxide can act to dissolve these masses such that they may be swept or flushed from wellbore 10 and near wellbore area 18 by the kinetic energy of the expanding treatment medium as described above.

This method of flushing any of the materials described above from wellbore 10 may be practiced in vertical or horizontal wells, and in wells which are open holes, partially cased holes, cased holes, or open hole completions with liners.

In another embodiment, jetting tool 70 can be used to impinge the treatment medium on the surface of wellbore 10 to form depressions such as, for example, slots in the rock face of the wellbore, increasing the surface area of wellbore 10 exposed to formation 50. Furthermore, jetting tool 70 may have multiple orifices such as protrusions or holes (not shown) through which treatment medium may be applied, thereby potentially creating multiple depressions in wellbore 10. In addition, jetting tools with multiple orifices which spin about the axis of tubing 60 can be used. Use of this type of jetting tool 70 may create a helical or rifling pattern of slots within wellbore 10, again, increasing the surface area of wellbore 10 exposed to formation 50.

This embodiment may be most beneficially used in sections of wellbore 10 which are open hole, meaning that at there is no casing 12 to interfere with the slotting process. Furthermore, so long as at least the liquid carbon dioxide portion of the treatment medium remains in the liquid state as it exits jetting tool 70, it may be preferable to leave wellbore 10 open at the surface. Furthermore, in a preferred embodiment, jetting tool 70 may be positioned such that it is centralized within wellbore 10, and such that the distance between the orifices and the surface of wellbore 10 allows the stream of treatment medium to be focused on the face of wellbore 10. In a more preferred embodiment, the distance between the orifice and the surface of wellbore 10 is between 0.5 in. and 1.0 in. Furthermore, in this embodiment, the pressure of the treatment medium as it exits jetting tool 70 may be regulated by regulating the pump pressure at the surface, accounting for the hydrostatic head of the treatment medium in tubing 60. Regulation of this pressure should take into account the material in which the wellbore is formed, the desired slot depth, and the rate at which jetting tool 70 is moved within wellbore 10. In a more preferred embodiment, pressure at the pump is between 2,000 and 5,000 psi.

In another embodiment, the present method, apparatus and treatment medium may be used to clean casing 12 and/or perforations 24 formed in casing 12. As described above, some wells include a casing 12, either throughout the entire wellbore, or over only a portion of the wellbore 10 as shown in FIG. 1 which illustrates a vertical section 10A with casing 12. Perforations 24 in casing 12 allow transference of gas and fluid between casing 12 and hydrocarbon bearing formation 50. Over time, perforations 24 can become partially or completely blocked by deposits such as paraffin, asphaltenes and/or any of the mineral deposits known as scale which may form on the inside of perforations 24 and/or of casing 12. These deposits may adversely affect the operation of the well by reducing the flow of hydrocarbons. The compositions, apparatus and methods of the present invention may be used to clean the perforations 24 and/or the casing 12 of these deposits by placing jetting tool 70 at specific locations of interest.

When applying the present invention to cased or partially cased wells, or open hole completions with liners, the method employed is substantially similar to that previously described in relation to the formation of depressions such as slots in wellbore 10. Specifically, tubing 60 with or without jetting tool 70 may be inserted into casing 12. Treatment medium may then be introduced or injected through tubing 60 and, if applicable, jetting tool 70 such that it impinges the inner surface of casing 12. As also previously described, the treatment medium may be allowed to partially vaporize, dislodging paraffin, asphaltenes and/or scale. As the partially vaporized treatment medium escapes to surface 1 through wellbore 10, it will sweep, carry and/or entrain undesirable materials, bringing them to the surface. The additional modes of cleaning associated with liquid carbon dioxide previously described may also assist in cleaning casing 12 and/or perforations 24.

Figure 2:
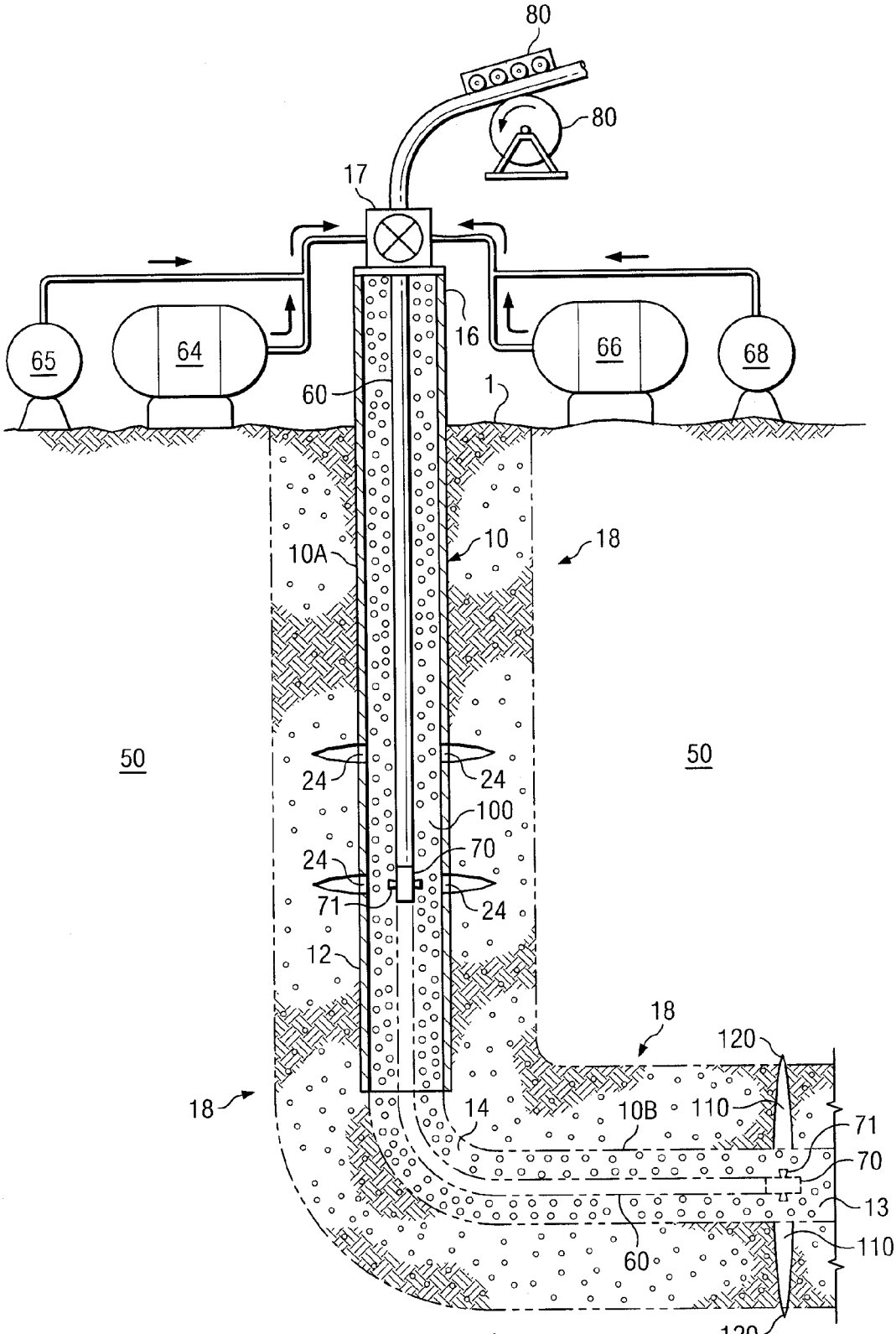
FIG. 2 is a schematic view of a well depicting one embodiment of the present invention used for fracturing a formation.

Turning now to FIG. 2, in yet another embodiment, the present invention may be useful in fracturing and/or "hydro-jetting" (described below) the hydrocarbon formation 50 in which wellbore 10 is located. The fracturing process typically involves injecting a fracturing fluid, stored in a tank 66 located at surface 1, into annulus 100 which may be formed between tubing 60 and either casing 12 or wellbore 10. The fracturing fluid can be pumped at a high rate and pressure into formation 50 such that fractures 110 in the formation are created, increasing the flow paths available for the hydrocarbons traveling from formation 50 into wellbore 10. In addition, a proppant such and/or as natural sand, or engineered products such as coated sand, sintered bauxite, and the like may be used. The proppant, which may be stored in a tank 68 located at surface 1, may be mixed with the fracturing fluid so that following injection of the fracturing fluid, the proppant may be left in the created fractures 110 so that fractures 110 are held open. However, the use of fracturing fluid itself may adversely affect production as the fluid may act to block pores in the formation. Specifically, many fracturing fluids are known to be somewhat viscous, thus, when used to fracture formations with low reservoir pressure, there is a possibility that the formation may not be able to expel some or all of the fracturing fluid. In the present invention, jetting of the treatment medium comprising liquid carbon dioxide may be used to mix with a fracturing fluid and/or proppant at the site of the perforations, fracture, or formation face thereby minimizing the fluid necessary to transport the proppant and further to drive the fracturing fluid/treatment medium mixture deep into formation 50 while the well is kept closed. Then, once fracturing has occurred, and the well may be opened releasing the pressure within the wellbore, the treatment medium comprising liquid carbon dioxide may be allowed to partially vaporize, providing energy to drive at least a portion of the fracturing fluid from the newly formed fractures 110. In general, at least a portion of the fracturing fluid may be comprised of water. Thus, the liquid carbon dioxide portion of the treatment medium may dissolve in this water while at the same time lowering the pH of the water. This action may aid in breaking any gels present in the fracturing fluid which may have been used to increase the viscosity of the fracturing fluid and fracturing transport capabilities. Furthermore, the liquid carbon dioxide portion of the treatment medium may act to provide energy to clean or propel the fracturing fluid back into the wellbore and thus to the surface.

Although proppant to fluid ratios are dependent upon many factors such as pump rate and fluid viscosity, typically 1 to 6 lbs. of proppant are used per gallon of fracturing fluid. However, in the method of the present invention, by jetting liquid carbon dioxide through the fracturing fluid/proppant slurry at or near a fracture point, it may be preferable to increase the proppant to fracturing fluid ratio as the liquid carbon dioxide portion of the treatment medium may expand and create a bi-phasic fluid which may provide increased transport capability.

In a typical fracturing process, a proppant free fracturing fluid or PAD is typically introduced into the wellbore to initiate the fracturing process. Once the fracture 110 has propagated, proppant may be added to the fracturing fluid while the pumping of the fracturing fluid continues. As known in the art, the properties of the fluid may be adjusted during the pumping process to adjust viscosity, chemistry and the like. Once the fracture tip 120 is bridged, proppant laden fracturing fluid continues to be pumped into fracture 110 to "balloon" or swell the fracture. A flushing fluid or proppant-free fracturing fluid is generally next introduced into the wellbore to push any remaining proppant laden fracturing fluid out of tubing 60 or wellbore 10 into the newly created fractures 110, leaving relatively proppant free tubing 60 and/or wellbore 10. Optionally, the flushing fluid may also be circulated to remove proppant from tubing 60, wellbore 10, and/or downhole equipment. Lastly, the well may be allowed to flow back to clear the tubing 60 and/or wellbore 10. FIG. 2 illustrates an embodiment of the present invention which may be used to fracture or re-fracture a formation 50.

In the present embodiment, a treatment medium comprising liquid carbon dioxide may be pumped through tubing 60 such that the pressure within the tubing may be higher than the annulus 100. Generally, this pressure may be between at least about 2000 psi to at least about 2,500 psi. Concurrently, a proppant laden, first fracturing fluid may be pumped by pumping means (not shown) down annulus 100 between tubing 60 and casing 12. It should be noted that annulus 100 may also refer to the space between tubing 60 and wellbore 10 in open hole or partially open hole wells or tubing 60 and the liner of an open hole completion with a liner (not shown). The treatment medium may then be injected into the proppant laden fracturing fluid in annulus 100 through means for focusing the stream of treatment medium, such as a nozzle or jetting tool 70 which may be located at a perforation 24 in the casing 12. The treatment medium may mix and/or entrain the first proppant laden fracturing fluid producing a second fracturing fluid which may impinge against the formation 50 and may erode a cavity within the formation 50 and may cause a micro fracture to occur. This process is known in the art as "hydro jetting" and is further described in EP 03 25 0274. Both the treatment medium and the first fracturing fluid rates may be increased as fractures 110 are propagated through the formation 50, resulting in an increased flow of the second fracturing fluid. As the second fracturing fluid may begin to expand, vaporize and begin to effervesce or foam, the ability of the second fracturing fluid to carry proppant can increase, causing the proppant to be more portable. Thus, it is believed the proppant will be carried closer to the tip 120 of the fractures 110. The partial vaporization of the second fracturing fluid may also result in increased fracturing activity. Although some of the gaseous second fracturing fluid may escape into the formation and/or be absorbed into surrounding formations, after the flushing step, when the well is opened to flow back and clear the annulus 100 and/or wellbore 10, the remaining fluid in the downhole fracturing fluid may exhaust itself to the surface 1 and exit to a lay down tank or pit (not shown). The present invention can have the additional benefit of the carbon dioxide component in the second fracture fluid cleaning the face of the fractures and the proppant surface similar to that described in the use of the treatment media to clean wellbores and near wellbore areas.

In another embodiment of the present invention, if the well cannot flow back on its own, liquid treatment media may be circulated down the tubing 60 into and out of the annulus 100. Once it has exited tubing 60, at least a portion of the treatment medium may be allowed to vaporize. As the portion of treatment vaporizes, it may seek to exit the wellbore through the annulus, and may carry and drive fluid from the annulus as it does so. The treatment fluid may be circulated and vaporized at successively deeper positions within the wellbore until the formation pressure is sufficiently high to overcome the hydraulic head of the fluid in the annulus 100 and clear the wellbore 10 and/or annulus 100 of fluids.

The present invention also includes an apparatus used for introducing the treatment medium into the wellbore 10. As previously discussed, in one embodiment of the apparatus of the invention, the treatment medium may be introduced through rigid, continuous non-jointed or coiled tubing 70, with the coiled tubing typically having an outside diameter of 1, 1¼, 1½, 1¾ or 2 inches. In one embodiment, the apparatus includes a jetting tool 70 operable to focus the treatment medium as it exits tubing 70. The use of a coiled tubing system may allow an operator to exercise greater control over the placement of the treatment medium to ensure that treatment is optimized over a desired length of wellbore 10. The use of coiled tubing systems to deliver well treatments other than a treatment medium containing liquid carbon dioxide to precise locations is known in the industry, and is exemplified by processes such as Halliburton's CobraMax$^{SM}$ and SurgiFrac$^{SM}$.

In the embodiments described above, additives may be added to the treatment medium. Specifically, substances such as, but not limited to alcohol, surfactant, corrosion inhibitor, acid, iron-control chemical abrasive, acid, and/or biocide may be added to the treatment medium prior to introduction into the wellbore. Generally, a mixing means 17 such as, but not limited to a helical mixer, batch mixer, jet mixer, paddle mixer, recirculating mixer or a simple bend in the transport tubing will be provided to aid in the mixing of the additives with the treatment medium. Similarly, in the previously described embodiment in which proppant may be used, although the proppant may be pre-mixed in the fracturing fluid, in an alternate embodiment, the proppant may be stored apart from the fracturing fluid and mixed with the fracturing fluid prior to introduction to the wellbore. In yet another embodiment, the fracturing fluid and proppant may be mixed with the treatment medium or liquid carbon dioxide and mixed in-situ wherein the liquid carbon dioxide is delivered within the wellbore through the jetting tool so that it contacts and mixes with the fracturing fluid with proppant at the perforations or formation face. Again, mixing means of the types described may be provided to aid in the mixing process.

Figure 3:
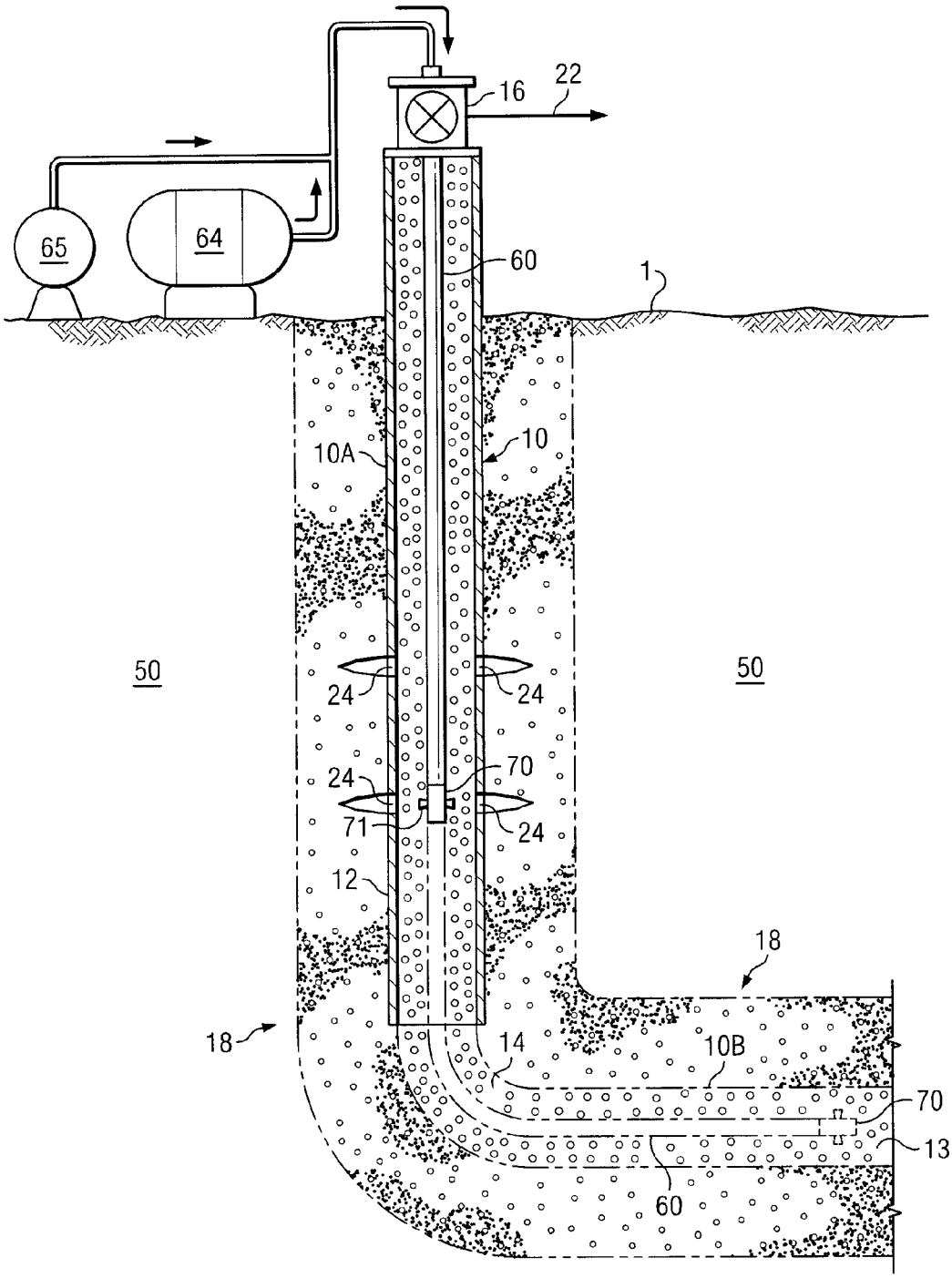
FIG. 3 is a schematic view of a partially cased well having a vertical section and deviated section as depicted in a coal bed methane formation and illustrating certain aspects of the present invention.

In alternate embodiments of the present invention, the previously described methods may be used in a coal bed methane well. In this embodiment, the apparatus and composition of the treatment medium are as previously described, as is the process through which undesirable water is removed. However, in the embodiment depicted in FIG. 3, because the apparatus and treatment medium may be used in connection with a wellbore located in a coal bed methane formation, the methods of employing the apparatus and composition of the present invention are different than previously described. Because the gas permeability of a coal bed formation may be generally greater than found in, for example, a hydrocarbon bearing sand formation, treatment medium may be introduced to the coal bed formation at a greater rate than could be achieved in a sand formation. In particular, at a given rate of introduction, the risk of undesirably fracturing the sand formation is greater than is generally found in a coal bed formation. Thus, in a preferred embodiment where formation fracturing is not desired, when utilizing the present invention in a coal bed methane formation, treatment medium may be introduced at a rate of at least 15 barrels per minute. In a more preferred embodiment, when utilizing the present invention in a coal bed methane formation, and depending on the characteristics of the equipment available, the wellbore 10 being treated and the formation 50 in which the wellbore 10 is located, treatment medium may be introduced at a rate of 50-60 barrels per minute.

The introduction of a treatment medium comprising liquid carbon dioxide to a wellbore and to the near-wellbore formation of a coal bed formation is believed to produce results similar to those described above. For example, it is believed that the liquid carbon dioxide is able to saturate at least a portion of the water present in the formation. Furthermore, liquid carbon dioxide may also be effective in dissolving oil, if present, in the near wellbore area. Thereafter, as described above, pressure within the well may be released, allowing the liquid carbon dioxide to vaporize, in turn causing the water to effervesce. In this state, capillary pressure may be defeated, mobilizing the water and any oil present. The vaporization of the carbon dioxide may also provide sufficient energy to remove the water and/or oil from the near wellbore formation, either by forcing the water and/or oil into the wellbore where it may be pumped to the surface, or may cause the water and/or oil to be driven deeper into the formation, where it may not impose a barrier to continued methane production.

In any of the embodiments of the methods and apparatus of the present invention, the treatment medium may be pumped by pumping means through, for example, 1, 1¼, 1½, 1¾ or 2 inches outside diameter flexible or coiled tubing 60 of the type used in the oil and gas production industry and known to those skilled in the art, although the use of rigid tubing will not deviate from the scope of the invention. Preferably, treatment medium may be pumped at a rate of at least 2 barrels per minute although that rate may be varied depending on the characteristics of the equipment available, the wellbore 10 being treated and the formation 50 in which the wellbore 10 is located. As is known in the art, coiled tubing 60 may be inserted into wellbore 10 through one of several known methods such as a motorized apparatus 80 used to drive or drag tubing 60. The length of rigid or flexible tubing 60 inserted into the wellbore 50 can be monitored. By measuring the length of tubing 60 inserted, the operator may know the location of jetting tool 70. In this manner, the operator directs the action of the treatment medium such that it is applied to desired locations, thereby increasing the likelihood that the cleaning, slotting, fracturing and/or hydrojetting occurs at areas in which it is most needed.

In any of the embodiments described above, it may be desirable to regulate pressure within the wellbore to maintain at least a portion of the treatment medium in a liquid state following injection into the wellbore and/or to achieve improved cleaning such as by cycling between high and low pressure states during the practice of the present method. Specifically, once a quantity of treatment medium has been introduced, pressure may be dropped to allow for the partial vaporization of the treatment medium as described above. However, rather than continuing with the low pressure state, the well may be closed to slow the vaporization rate of the treatment medium. It is believed that by cycling between high and low pressure states, the cleaning benefits described above may be enhanced by the pulsing action created. Furthermore, it is believed that at times when the well is closed, allowing a portion of the treatment medium to remain in the liquid phase will enable the treatment medium to better penetrate the wellbore and near wellbore areas which may be desired depending on the application. Thus, when the well is next cycled to the open position, the depressurization of well 10 and subsequent vaporization of at least a portion of the treatment medium may remove greater amounts of fluids, dust, and drilling residue and other undesirable materials.

The time period of contact of the treatment medium with the near wellbore area can vary. Generally, there may be no need for prolonged contact between the treatment medium and the wellbore 10 or casing 12. In the embodiments utilizing pressure cycling, pressure may be released as soon as the pumping of treatment medium has been completed rather than risk escape into the formation such that there may be no energy left in the treating medium to propel undesirable materials to the surface.

The methods, apparatus and compositions of the present invention described above may be employed both on vertical wellbores as well as deviated or horizontal wellbores, multilateral and what is known in the art as "fishbone" wellbores. As applied to horizontal wellbores, the present invention may be used to precisely clean one or more sections of a horizontal shaft anywhere between the heel and toe of the shaft. Furthermore, the methods, apparatus and compositions of the present invention described above may be employed on cased, partially open hole (which may also be called a partially cased hole), and open hole wells as well as open hole completions with liners.

In embodiments of the method of the present invention where formation fracturing is not desired, it may be desirable to pump treatment medium into the wellbore such that the pressure in the near wellbore area 18 is kept below the fracturing pressure of formation 50. The pressure of the treatment medium before it exits tubing 60 will be approximately the pressure the pump is applying at the surface together with the pressure resulting from the hydrostatic head of the column of treatment medium in tubing 60. Preferably, treatment medium is pumped into the formation 50 such that the pressure of the treatment medium in the near wellbore area 18 is less than the fracturing pressure and, more preferably, at a pressure which is 75% or less of the fracturing pressure, and even more preferably, 50% or less of the fracturing pressure. Exceeding the fracturing pressure may result in the loss of treatment medium, because the treatment medium may fracture the formation creating fissures that may allow at least a portion of the treatment medium to vaporize and escape into the formation rather than remain in the near wellbore area where it is best able to perform work as described above.

In any of the embodiments previously described, the addition of additives and/or acids may be beneficial in the cleaning process. As described, the present methods can be practiced by having a treatment medium comprising liquid carbon dioxide. However, the liquid treatment medium may further be comprised of one or more additives such as alcohols, surfactants, corrosion inhibitors, acid, iron-control chemicals, and/or biocides. As shown in FIG. 1, these additives may be stored in one or more tanks 65 located at surface 1. In one embodiment, the liquid carbon dioxide may be mixed with alcohol and a surfactant to achieve a resultant composition by volume as follows:

| | Preferred | Most Preferred |
|---|---|---|
| Liquid carbon dioxide | 84.5 to 100% | 88.8 to 100% |
| Alcohol | 0 to 15% | 0 to 11% |
| Surfactant | 0 to 0.5% | 0 to 0.2% |

The alcohol can be methanol. The alcohol and surfactant can be mixed and metered into the liquid carbon dioxide by drawing it into the line carrying the liquid carbon dioxide by the pumping action and mixed in the line. If desired, a small portion of alcohol can be injected into the wellbore before the treatment medium is injected using the same apparatus.

It is useful to obtain a condensate and water sample from the well to be treated. The samples can be utilized to test which additives are compatible for use in the wellbore and/or formation to be treated and therefore would be beneficial to include in the treatment medium. The selected additives should not produce an emulsion when mixed with a sample of asphaltenes or condensates found in the condensate and/or water sample. It is undesirable to form an emulsion in the near wellbore area as the emulsion may block the formation and defeat the purpose of cleaning. Nor should the treatment medium form a foam before being introduced within the wellbore. Foaming before injection into the wellbore may create pumping problems and reduce the amount of treatment fluid which may flow into the near wellbore area.

A suitable combination of additives which do not form an emulsion can also act as a breaker composition down hole. A breaker composition is useful to reduce the surface tension of water in the formation, thereby reducing the pressure needed to overcome the capillary force of the water lodged in the pores of the rock. This may assist in the displacement of the water from the formation.

In addition, it may be desirable to include an abrasive such as sand, composites, bauxite and/or garnet in the treatment medium to increase cleaning capacity of the treatment medium. Generally, abrasive will be mixed with treatment medium in a ratio of at least about 0.25 pounds of abrasive per gallon of treatment medium to about 1 pound of abrasive per gallon of treatment medium.

Although the invention has been disclosed and described in relation to its preferred embodiments with a certain degree of particularity, it is understood that the present disclosure of some preferred forms is only by way of example and that numerous changes in the details of construction and operation and in the combination and arrangements of parts may be resorted to without departing from the spirit of the scope of the invention as claimed here.

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, the terms "comprising," "comprises," and "comprise" are open-ended transition terms used to transition from a subject recited before the term to one or more elements recited after the term, where the element or elements listed after the transition term are not necessarily only elements that make up of the subject.

As used herein, the terms "including," "includes," and "include" have the open-ended meaning as "comprising," "comprises," and "comprise."

As used herein, the terms "having," "has," and "have" have the same open-ended meaning as "comprising," "comprises," and "comprise."

As used herein, the terms "containing," "contains," and "contain" have the same open-minded meaning as "comprising," "comprises," and "comprise."

As used herein, the terms "a," "an," "the," and "said" mean one or more.

As used herein, the term "and/or," when used in a list of two or more items, means that anyone of the listed items can be employed by itself or any combination of two or more of the listed items can be employed. For example, if a composition is described as contained components A, B and/or C, the composition can contain A alone; B alone; C alone; A and B in combination; A and C in combination; B and C in combination; or A, B, and C in combination.

As used herein, the term "liquid" as applied to the treatment medium includes liquid and dense phase states also known as critical and super critical phases.

The invention claimed is:

1. A method for cleaning a wellbore and near wellbore areas in a coal bed methane formation comprising the steps of: inserting a desired length of tubing into said wellbore; introducing a treatment medium comprising liquid carbon dioxide through said tubing from a jetting tool at the distal end of the tubing and arranged to direct the carbon dioxide into one or more locations within said wellbore and into at least a portion of said formation adjacent to said wellbore; moving the tubing such that carbon dioxide is introduced to another location within said wellbore and into another portion of the formation adjacent the wellbore and vaporizing at least a portion of said treatment medium after it is injected into said wellbore.

2. The method of claim 1, further comprising the steps of: prior to introducing said treatment medium, closing said wellbore; regulating pressure within said wellbore such that at least a portion of said treatment medium remains in a liquid state following injection into said wellbore; and following injection of said treatment medium, releasing said pressure within said wellbore such that at least a portion of said treatment medium vaporizes.

3. The method of claim 2 further comprising the step of repeating said steps of closing said wellbore, and releasing said pressure at least once.

4. The method of claim 1, wherein said tubing is coiled tubing.

5. The method of claim 1 wherein at least a portion of said wellbore is drilled at an angle of greater than zero degrees from vertical.

6. The method of claim 1 further comprising the step of injecting said treatment medium at a rate of at least 15 barrels per minute.

7. The method of claim 1, wherein said wellbore is at least a partially open hole wellbore.

8. The method of claim 1, wherein said wellbore is an open hole completion.

9. The method of claim 1, wherein at least a portion of said treatment medium dissolves in water.

10. The method of claim 1, wherein said vaporized treatment medium removes undesirable materials and/or water from said wellbore and near wellbore areas.

11. The method of claim 1 further comprising the step of injecting said treatment medium at a rate of at least 50 barrels per minute.

12. The method of claim 1 wherein said treatment medium further comprises alcohol, surfactant, corrosion inhibitor, acid, iron-control chemical, biocide, and/or abrasives.

13. The method of claim 1, wherein said treatment medium is in the following proportions by volume: from about 84.5 to 100% liquid carbon dioxide; from about 0 to 15% of an alcohol; and from about 0 to 0.5% surfactant.

14. An apparatus for introducing a treatment medium into a desired space comprising: a storage means for storing a quantity of a treatment medium; a pumping means for delivering said treatment medium to a transport means; said transport means inserted into said space and operable to transport a quantity of said treatment medium to a location within said desired space; and means for directing said treatment medium onto a location within said desired space; wherein said treatment medium is comprised of liquid carbon dioxide and said desired space is defined by at least a portion of a wellbore, a casing within said wellbore, a region of a wellbore located in a coal bed methane formation and/or at least a portion of a coal bed methane formation near said wellbore; and means for relocating said directing means to a different location in said wellbore wherein the apparatus is configured to introduce the treatment medium to one or more other locations within said wellbore.

15. The apparatus of claim 14 wherein said transport means comprises flexible tubing.

16. The apparatus of claim 15 further comprising means for measuring the position of said tubing inserted into said wellbore.

17. The apparatus of claim 14 wherein said pumping means is capable of pumping said treatment medium comprising liquid carbon dioxide such that at least a portion of said treatment medium remains in a liquid state.

18. The apparatus of claim 14 further comprising means for regulating pressure within at least one of said wellbore and said coal bed methane formation wherein said pressure within said coal bed methane formation is maintained below the fracturing pressure of said coal bed methane formation.

19. A method for removing liquids from a wellbore and the near wellbore areas of a coal bed methane formation comprising the steps of: inserting a desired length of tubing into said wellbore; introducing a treatment medium comprising liquid carbon dioxide through said tubing into one or more locations within said wellbore and into at least a portion of said formation adjacent to said wellbore; and vaporizing at least a portion of said treatment medium after it is injected into said wellbore.

20. The method of claim 19, wherein said liquids comprise water and/or oil further comprising the step of mobilizing said water and/or oil.

21. The method of claim 19, further comprising the steps of: prior to introducing said treatment medium, closing said wellbore; regulating pressure within said wellbore such that at least a portion of said treatment medium remains in a liquid state following injection into said wellbore; and following injection of said treatment medium, releasing said pressure within said wellbore such that at least a portion of said treatment medium vaporizes.

22. The method of claim 19 further comprising the step of repeating said steps of closing said wellbore, and releasing said pressure at least once.

23. The method of claim 19 wherein the step of vaporizing at least a portion of said treatment medium includes vaporizing treatment medium in the coal bed methane formation to move liquids that are in the formation from the formation to the wellbore and exit the wellbore at the surface.

* * * * *